US008393606B2

(12) United States Patent
Wang et al.

(10) Patent No.: US 8,393,606 B2
(45) Date of Patent: Mar. 12, 2013

(54) PRINTING DEVICE WITH DETACHABLE STAPLING DEVICE

(75) Inventors: Chung-Kai Wang, Taipei (TW); Ching-Tse Wang, Taipei (TW); Ming-Han Chiu, Taipei (TW); Chung-Jung Chiu, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 28 days.

(21) Appl. No.: 13/159,641

(22) Filed: Jun. 14, 2011

(65) Prior Publication Data

US 2012/0267841 A1 Oct. 25, 2012

(30) Foreign Application Priority Data

Apr. 22, 2011 (TW) ..... 100114026 A

(51) Int. Cl.
*B65H 37/04* (2006.01)

(52) U.S. Cl. ..... 270/58.08; 270/52.18; 399/410

(58) Field of Classification Search ..... 270/37, 270/52.18, 58.07, 58.08; 399/110, 408, 410
See application file for complete search history.

(56) References Cited

U.S. PATENT DOCUMENTS 4,087,142 A * 5/1978 Aumack ..... 312/236
4,433,881 A * 2/1984 Witten et al. ..... 312/107.5
5,630,578 A * 5/1997 Naramore et al. ..... 270/58.08
6,671,492 B2 * 12/2003 Mimura et al. ..... 399/407
7,431,287 B2 * 10/2008 Hayashi et al. ..... 271/162

* cited by examiner

*Primary Examiner* — Leslie A Nicholason, III
(74) *Attorney, Agent, or Firm* — Kirton McConkie; Evan R. Witt

(57) ABSTRACT

The present invention discloses a printing device with a detachable stapling device including a printing device housing, a connecting frame and a stapling device. The connecting frame has a locating post and a fixing hook and is connected with the stapling device. The position of the connecting frame can be adjusted by the locating post of the connecting frame, and the connecting frame can be assembled on the printing device housing or detached from the printing device housing by the fixing hook.

9 Claims, 8 Drawing Sheets

PRINTING DEVICE WITH DETACHABLE STAPLING DEVICE

FIELD OF THE INVENTION

The present invention generally relates to a printing device, and more particularly to a printing device with a detachable stapling device.

BACKGROUND OF THE INVENTION

In general, the printing devices include photocopiers, printers and office machines integrating functions of photocopiers, printers and scanners together, wherein the printers are most commonly used. A conventional printer may print from one side of a paper only. When a user desires to print on both sides of a paper, the user needs to print a first page of a document file in a computer onto a first side of a blank paper by the conventional printer first. After the first page of the document file is finished printing, the paper printed with an image of the first page of the document file need to be flipped upside down and put into an input tray of the conventional printer. Thereafter, the conventional printer may further print a second page of the document file on a second side of the paper. However, it is quite inconvenient to repeatedly flip and put the paper manually if the amount of pages of the document file is huge. Therefore, a printing device with a two-sided print function, which may flip and put papers automatically, is developed and popularly used by personal users and many companies.

No matter which the single side printing device or the double side printing device is, a plurality of printed papers are fed onto an output tray of the printing device after the printing device finishes printing. Next, most of users take the plurality of papers out of the output tray and staple them together by using a stapling device, such as a stapler. Therefore, it is not only able to avoid the papers strewing over but also easy to store and gather up the papers. However, during the above-mentioned process of manually stapling, users must wait for the printing device finishing the printing process before stapling the plurality of papers manually. Accordingly, a printing device with a stapling device is developed.

FIG. 1 illustrates a schematic side view of a conventional printing device with a stapling device. Referring to FIG. 1, the printing device 1 comprises a printing device housing 10, an input tray 11, a printing module 12, a first feeding passage 13, a plurality of first feeding roller sets 14 and a stapling device 15. The printing device housing 10 has an upper surface 101 and a paper outlet 102, wherein the paper outlet 102 is exposed on the upper surface 101. The input tray 11 is disposed in the printing device housing 10 and capable of carrying a plurality of papers P thereon. The first feeding passage 13 is disposed within the printing device housing 10, disposed between the input tray 11 and the paper outlet 102, and capable of letting the plurality of papers P pass through. The plurality of first feeding roller sets 14 are disposed on the first feeding passage 13 and capable of feeding the plurality of papers P on the input tray 11 to the paper outlet 102. The printing module 12 is disposed on the first feeding passage 13 and capable of printing images on the plurality of papers P. The stapling device 15 is disposed on the upper surface 101 of the printing device housing 10 and covers the paper outlet 102, wherein the stapling device 15 comprises a stapling module 151, a stapling tray 152, a second feeding passage 153 and a plurality of second feeding roller sets 154.

In the stapling device 15, the second feeding passage 153 contacts with the paper outlet 102 on the printing device housing 10, so as to connect the second feeding passage 153 with the first feeding passage 13, and then the plurality of papers P is able to pass through thereon. The plurality of second feeding roller sets 154 are disposed on the second feeding passage 153 and capable of feeding the plurality of papers P from the first feeding passage 13 to the stapling tray 152. The stapling tray 152 is capable of carrying the plurality of papers P. The stapling module 151 is located at a side of the stapling tray 152 and capable of stapling the plurality of papers P on the stapling tray 152. The printing device 1 with the stapling device 15 may staple the plurality of papers P by using the stapling device 15 after the printing device 1 finishes the printing process. Therefore, users do not need to wait for finishing printing and manually staple the plurality of papers P anymore, and thus it is able to save not only the waiting time for printing but also the process of manually stapling.

It can be understood from FIG. 1 that the stapling device 15 is disposed above the printing device housing 10, and the second feeding passage 153 perpendicularly connects with the first feeding passage 13. Therefore, a feeding route of the plurality of papers P is formed a straight line from bottom to top, and thus a total height of the printing device 1 is significantly increased due to the vertical disposing conformation.

FIG. 2 illustrates a schematic side view of another conventional printing device with a stapling device. Referring to FIG. 2 hereinafter, the printing device 2 comprises a printing device housing 20, an input tray 21, a printing module 22, a first feeding passage 23, a plurality of first feeding roller sets 24 and a stapling device 25. The printing device housing 20 has a rear surface 201 and a paper outlet 202, wherein the paper outlet 202 is exposed on the rear surface 201. The input tray 21 is disposed in the printing device housing 20 and capable of carrying a plurality of papers P thereon. The first feeding passage 23 is disposed within the printing device housing 20, disposed between the input tray 21 and the paper outlet 202, and capable of letting the plurality of papers P pass through. The plurality of first feeding roller sets 24 are disposed on the first feeding passage 23 and capable of feeding the plurality of papers P on the input tray 21 to the paper outlet 202. The printing module 22 is disposed on the first feeding passage 23 and capable of printing images on the plurality of papers P. The stapling device 25 is disposed on the rear surface 201 of the printing device housing 20 and covers the paper outlet 202, wherein the stapling device 25 comprises a stapling module 251, a stapling tray 252, a second feeding passage 253 and a plurality of second feeding roller sets 254.

In the stapling device 25, the second feeding passage 253 contacts with the paper outlet 202 on the printing device housing 20, so as to connect the second feeding passage 253 with the first feeding passage 23, and then the plurality of papers P is able to pass through thereon. The plurality of second feeding roller sets 254 are disposed on the second feeding passage 253 and capable of feeding the plurality of papers P from the first feeding passage 23 to the stapling tray 252. The stapling tray 252 is capable of carrying the plurality of papers P. The stapling module 251 is located at a side of the stapling tray 252 and capable of stapling the plurality of papers P on the stapling tray 252. Similar to the above-mentioned conventional printing device 1, the printing device 2 with the stapling device 25 also has advantages of no need to wait for finishing printing and manually staple anymore. Since the stapling device 25 is disposed on the rear surface 201 of the printing device housing 20, it is able to horizontally connect the second feeding passage 253 with the first feeding passage 23 and design the second feeding passage 253 into a curved route. Therefore, an increased total height of the printing device 2 with the stapling device 25 is reduced, so as to avoid the height of the printing device overhigh.

In general, the rear surface 201 of the printing device housing 20 can be opened for troubleshooting. However, since the stapling device 25 is disposed on the rear surface 201 of the printing device housing 20, the stapling device 25 must be detached from the rear surface 201 of the printing device housing 20 before opening the rear surface 201 of the printing device 2 for troubleshooting when users desire to do troubleshooting. No matter which the printing device 1 of FIG. 1 or the printing device 2 of FIG. 2 needs to be troubleshooting (for example when the paper jam issue is happened), the stapling device must be detached from the printing device housing by using a hand tooling, such as a screw driver. It is inconvenient that using additional tools for detaching is necessary. Accordingly, it is necessary to provide a printing device with a detachable stapling device, wherein the stapling device is able to be detached without using any additional tools.

SUMMARY OF THE INVENTION

The present invention is directed to a printing device with a detachable stapling device, wherein the stapling device is able to be detached without using any additional tools.

In a preferred embodiment, the present invention provides a printing device with a detachable stapling device capable of printing images on a plurality of papers, wherein the printing device with a detachable stapling device comprises:

- a stapling device capable of stapling the plurality of papers, wherein the stapling device has a stapling device housing;
- a printing device housing having a locating hole and a fixing slot, wherein the locating hole and the fixing slot are exposed on a surface of the printing device housing, and the fixing slot is located at a side of the locating hole;
- a connecting frame connected with the stapling device housing and capable of fixing the stapling device on the printing device housing, wherein the connecting frame comprises:
  - a fixing hook disposed at a side of the connecting frame, able to swing relative to the connecting frame, and capable of inserting into the fixing slot and fastening with the fixing slot, so as to fixing the connecting frame on the printing device housing and thus connecting the stapling device housing and the printing device housing; and
  - a locating post disposed at a side of the fixing hook and capable of inserting into the locating hole, so as to separate the surface of the printing device housing from the stapling device housing, wherein the locating post comprises:
    - a first segment having a first diameter, wherein the first diameter is smaller than an internal diameter of the locating hole, and the first segment is capable of inserting into the locating hole; and
    - a second segment having a second diameter, wherein the second diameter is larger than the internal diameter of the locating hole, and the second segment is capable of contacting with the surface of the printing device housing, so as to separate the surface of the printing device housing from the stapling device housing.

In a preferred embodiment, the connecting frame further comprises:

- a carrying portion capable of supporting the stapling device housing;
- an extending portion located at a side of the connecting frame and perpendicular to a surface of the connecting frame; and
- a sleeve disposed on the extending portion and perpendicular to the extending portion.

In a preferred embodiment, the fixing hook is disposed on the extending portion, and the sleeve, the extending portion and the connecting frame are formed integrally.

In a preferred embodiment, the fixing hook comprises a sliding groove, and the extending portion comprises a protruding portion. The protruding portion is extended from the extending portion, located under the sleeve and capable of inserting into the sliding groove, so as to restrict the fixing hook swinging.

In a preferred embodiment, the fixing hook comprises:

- an opening;
- a rotation shaft passing through the sleeve of the connecting frame, and capable of rotating relative to the connecting frame when the fixing hook is swinging;
- a poking portion perpendicular to the extending portion of the connecting frame and capable of being poked to drive the fixing hook swinging; and
- a torsion spring fitting onto the sleeve, wherein a first end of the torsion spring leans against another surface of the connecting frame, and a second end of the torsion spring inserts into the opening and connects with the opening, so as to provide a torsion to the fixing hook.

In a preferred embodiment, the printing device with the detachable stapling device of the present invention further comprises a hook control module contacting with the poking portion of the fixing hook and capable of being pressed, so as to drive the fixing hook swinging relative to the connecting frame, wherein the hook control module comprises:

- a pressing portion contacting with the poking portion and capable of being pressed to lean against the poking portion, so as to drive the fixing hook swinging relative to the connecting frame;
- a convex post disposed on the pressing portion; and
- a spring fitting onto the convex post and capable of generating an elastic force.

In a preferred embodiment, the stapling device housing comprises a side wall, and the side wall comprises:

- a containing space capable of containing the pressing portion; and
- a convex post container disposed at a side of the containing space and capable of containing the convex post therein, wherein the convex post container has a convex post container rim capable of leaning against the spring when the pressing portion is pressed.

In a preferred embodiment, the printing device with the detachable stapling device of the present invention further comprises a paper outlet located on the surface of the printing device housing to let the plurality of papers pass through and then leave away the printing device housing. In addition, the stapling device further comprises a paper inlet disposed on the stapling device housing and located under the connecting frame to let the plurality of papers pass through and then enter into the stapling device. Herein, the paper outlet is separated from the paper inlet by the second segment of the locating post.

In a preferred embodiment, the printing device with the detachable stapling device of the present invention further comprises:

- an input tray located at a bottom of the printing device housing and capable of carrying the plurality of papers;

a first feeding passage located between the input tray and the paper outlet, and capable of feeding the plurality of papers;

a plurality of first feeding roller sets disposed on the first feeding passage and capable of feeding the plurality of papers to move in the first feeding passage; and a printing module disposed on the first feeding passage and capable of printing the plurality of papers; and the stapling device further comprising:

an output tray located in the stapling device housing and capable of carrying the plurality of papers;

a second feeding passage located between the paper inlet and the output tray and capable of feeding the plurality of papers;

a plurality of second feeding roller sets disposed on the second feeding passage and capable of feeding the plurality of papers to move in the second feeding passage; and a stapling module disposed above the output tray and capable of stapling the plurality of papers.

In a preferred embodiment, the printing device housing comprises a connecting piece disposed on the surface of the printing device housing, and the locating hole and the fixing slot are disposed on the connecting piece, so as to exposing the locating hole and the fixing slot on the surface.

DETAILED DESCRIPTION OF THE PREFERRED EMBODIMENT

Figure 1:
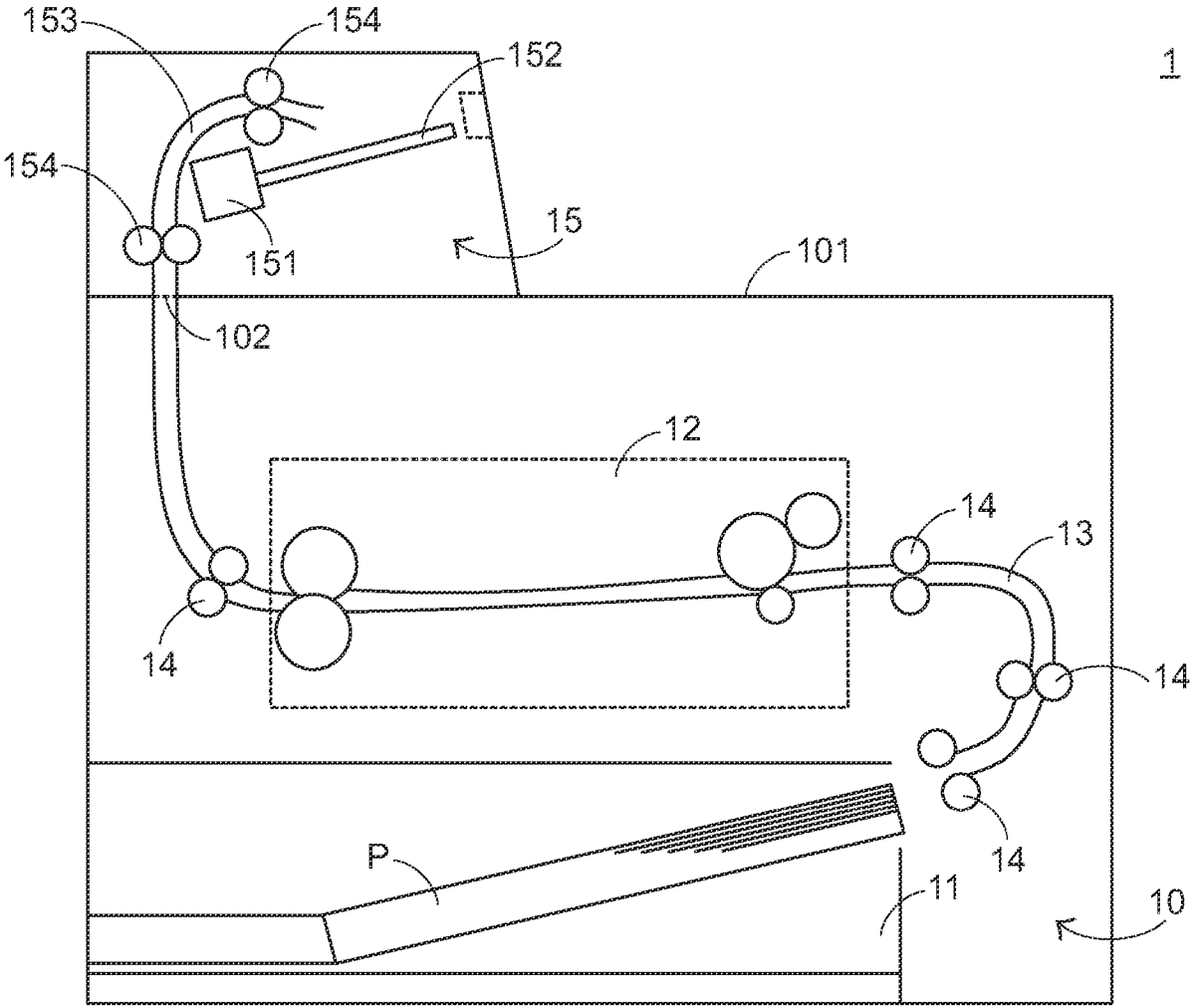
FIG.1 PRIOR ART
FIG. 1 illustrates a schematic side view of a conventional printing device with a stapling device.
Figure 2:
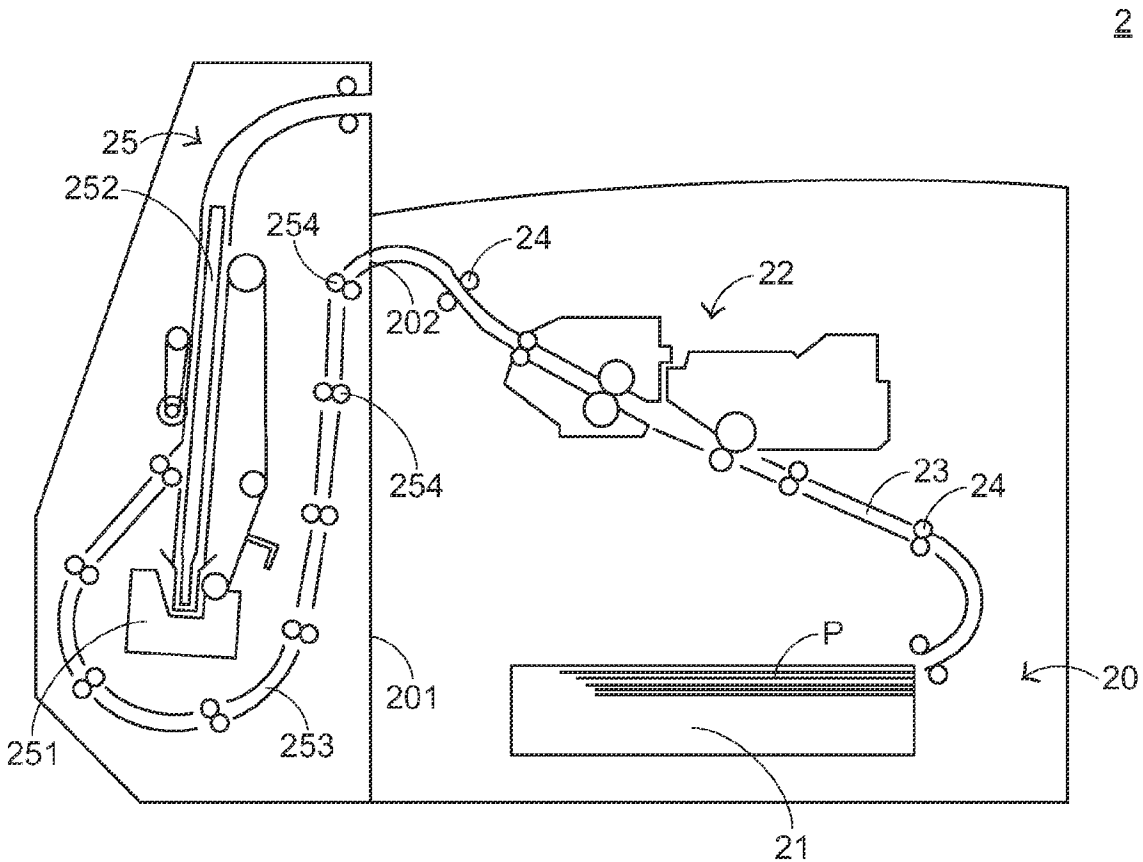
FIG.2 PRIOR ART
FIG. 2 illustrates a schematic side view of another conventional printing device with a stapling device.
Figure 3:
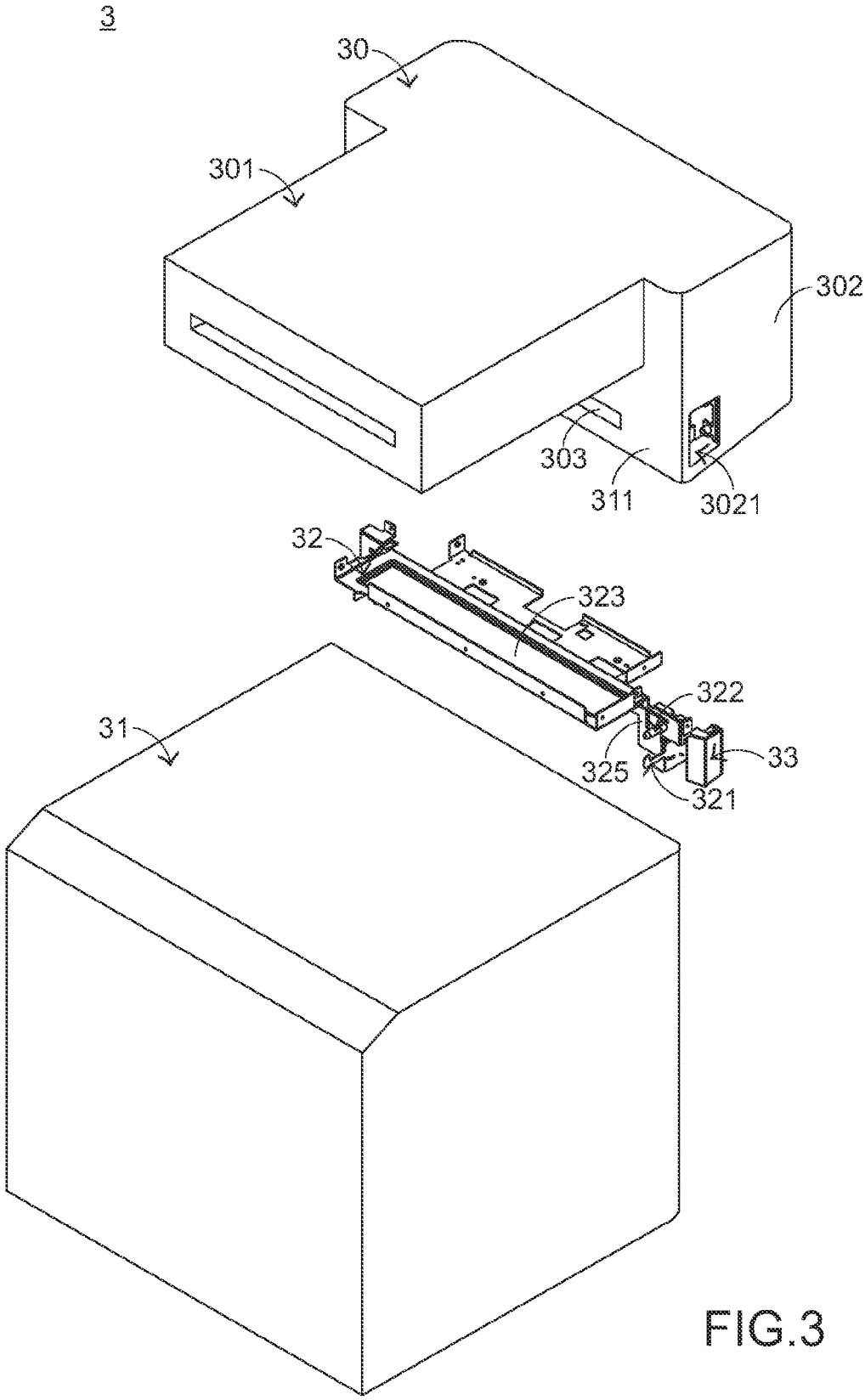
FIG. 3 illustrates a schematic structural explosion view of a printing device with a detachable stapling device according to a preferred embodiment of the present invention.
Figure 4:
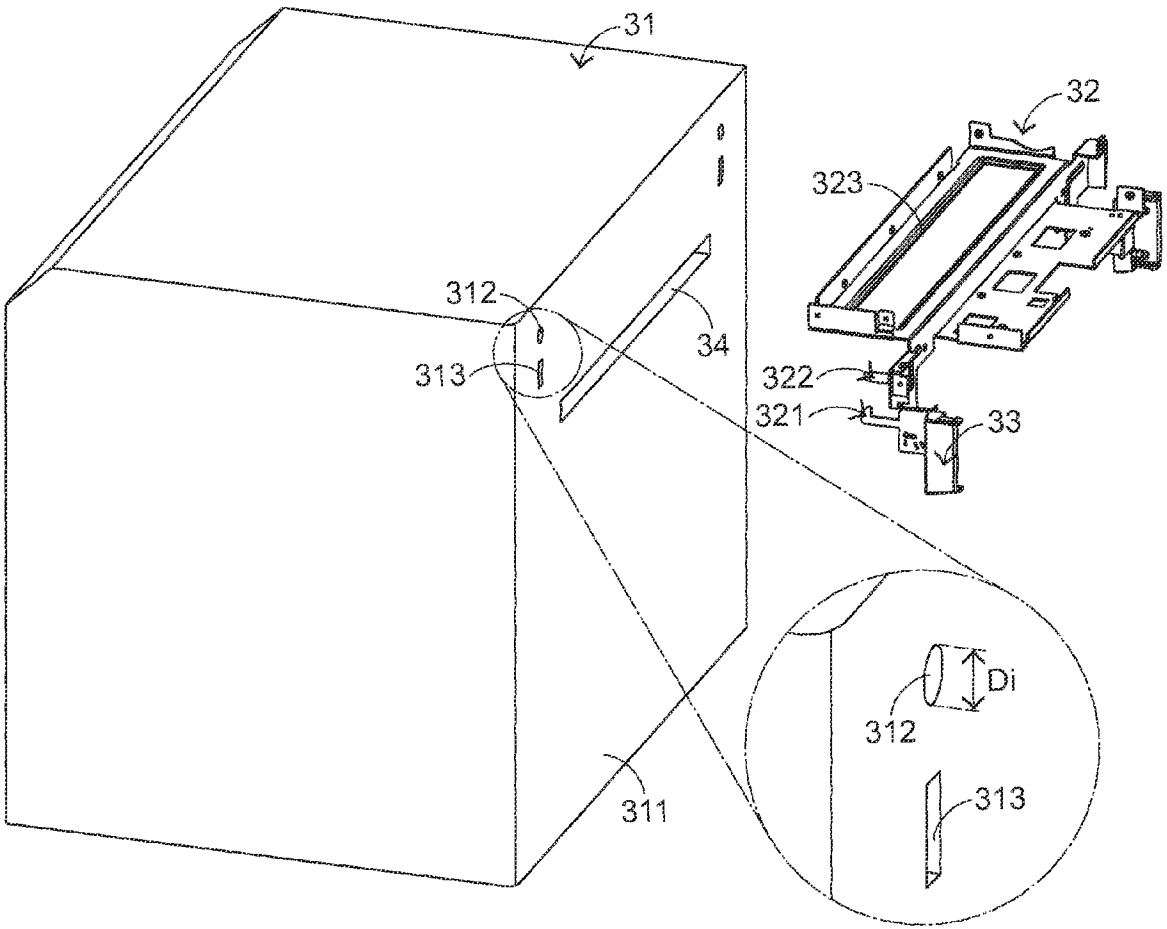
FIG. 4 illustrates a schematic outer contour view of a printing device housing and a connecting frame of a printing device with a detachable stapling device from another view angle according to a preferred embodiment of the present invention.

In view of the defects of the conventional arts, the present invention provides a printing device with a detachable stapling device, wherein the stapling device is able to be detached without using any additional tools. FIG. 3 illustrates a schematic structural explosion view of a printing device with a detachable stapling device according to a preferred embodiment of the present invention. FIG. 4 illustrates a schematic outer contour view of a printing device housing and a connecting frame of a printing device with a detachable stapling device from another view angle according to a preferred embodiment of the present invention. Referring to FIG. 3 and FIG. 4 together, a printing device 3 with a detachable stapling device is capable of printing images on a plurality of papers P (referring to FIG. 6) and comprises a stapling device 30, a printing device housing 31, a connecting frame 32 and a hook control module 33. The stapling device 30 is capable of stapling the plurality of papers P, and the stapling device 30 comprises a stapling device housing 301 and a paper inlet 303. The stapling device housing 301 comprises a side wall 302, and the side wall 302 has a containing space 3021. The paper inlet 303 is disposed on the stapling device housing 301 and located under the connecting frame 32 to let the plurality of papers P pass through and then enter into the stapling device 30. Further, the connecting frame 32 connects with the stapling device housing 301 and is capable of fixing the stapling device 30 on the printing device housing 31.

In FIG. 4, the printing device 3 further comprises a paper outlet 34 located on a surface 311 of the printing device housing 31 to let the plurality of papers P pass through and then leave away the printing device housing 31. Furthermore, the printing device housing 31 has a locating hole 312 and a fixing slot 313, wherein the locating hole 312 and the fixing slot 313 are exposed on the surface 311 of the printing device housing 31, and the fixing slot 313 is located at a side of the locating hole 312. Note that structures and functions of the hook control module 33 are illustrated later.

Figure 5:
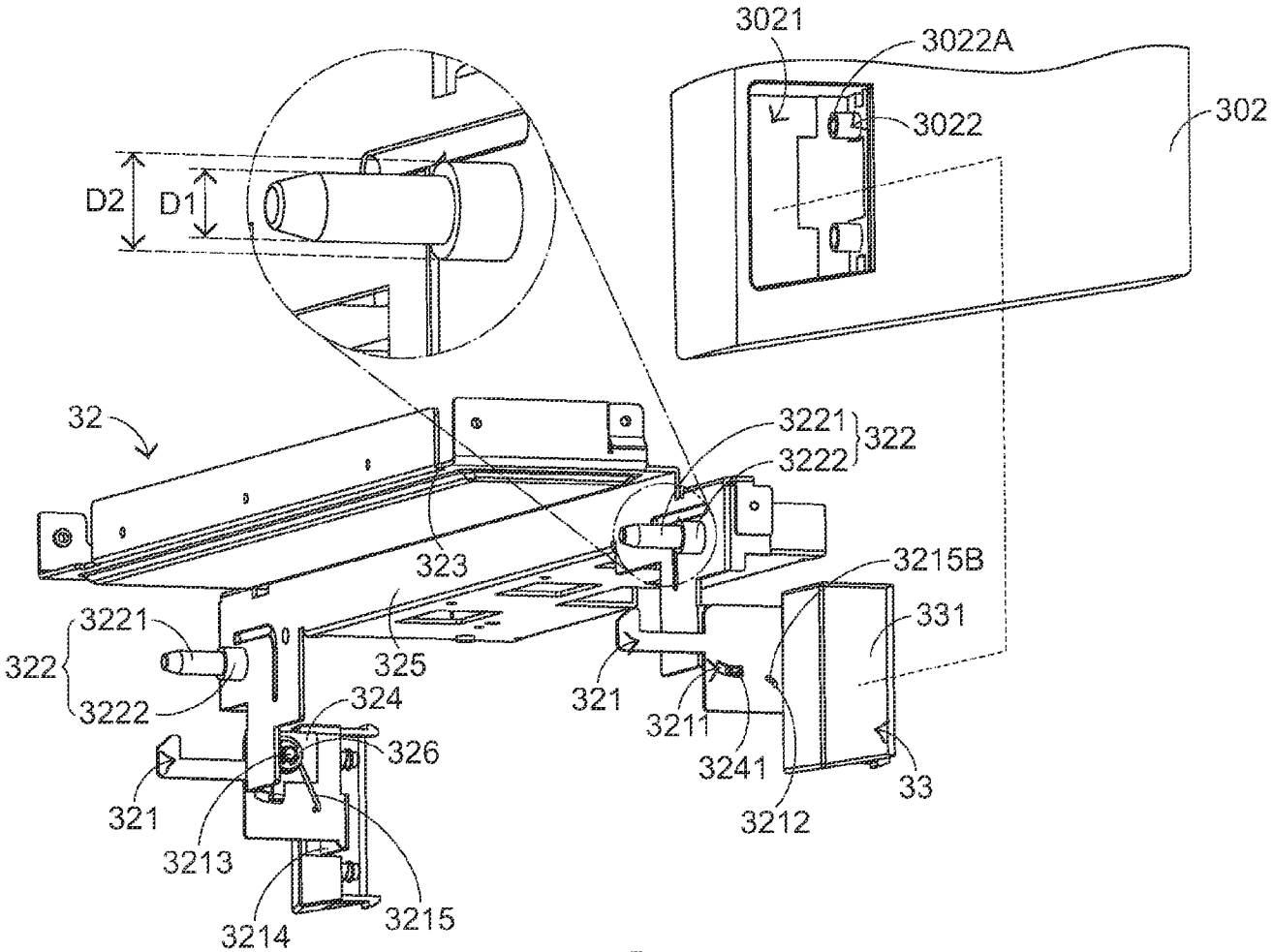
FIG. 5 illustrates a schematic structural view of a connecting frame of a printing device with a detachable stapling device according to a preferred embodiment of the present invention.
Figure 6:
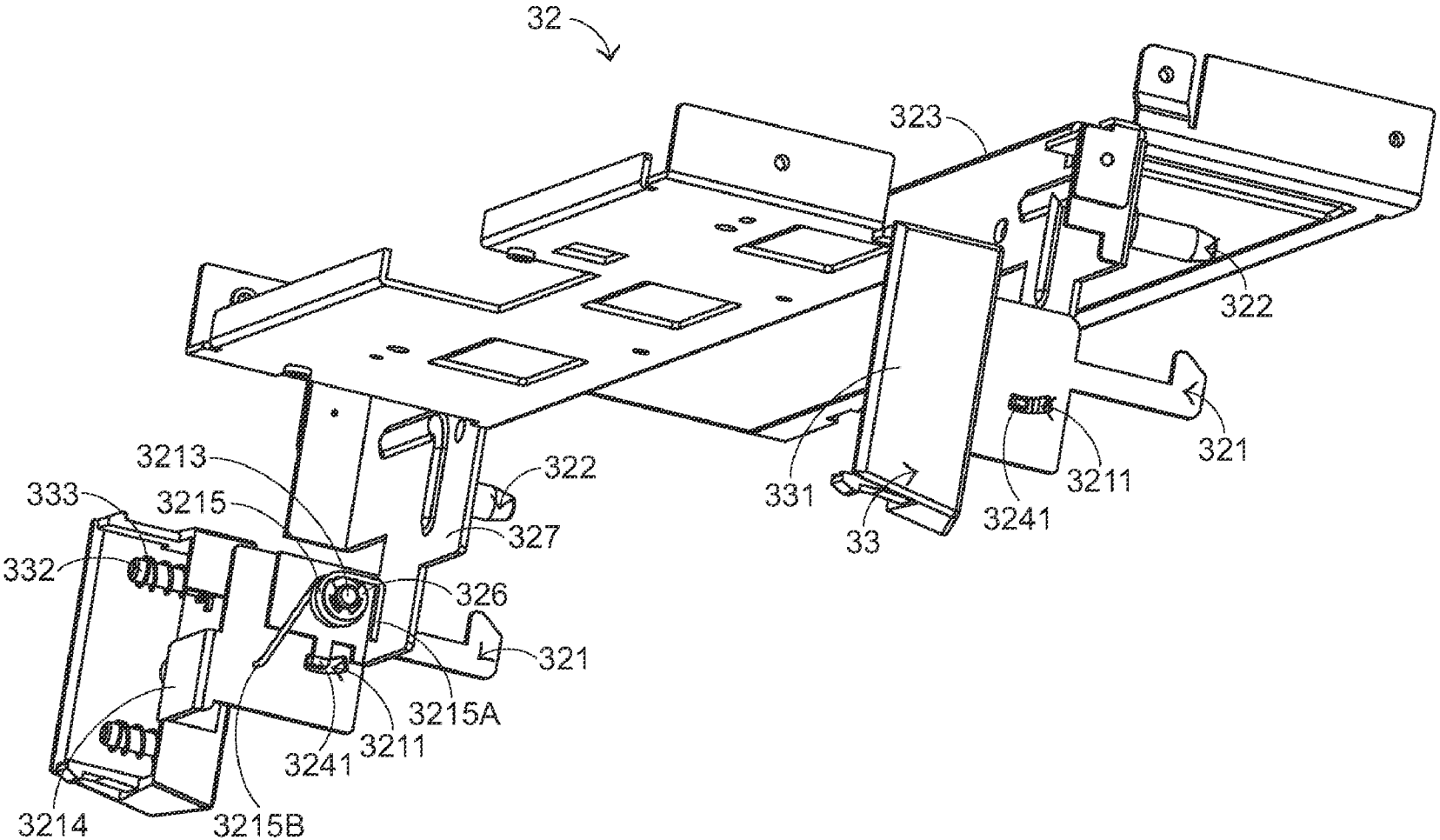
FIG. 6 illustrates a schematic structural view of a connecting frame of a printing device with a detachable stapling device from another view angle according to a preferred embodiment of the present invention.

Structures of the connecting frame 32 of the printing device 3 with the detachable stapling device are illustrated herein after. FIG. 5 illustrates a schematic structural view of a connecting frame of a printing device with a detachable stapling device according to a preferred embodiment of the present invention. FIG. 6 illustrates a schematic structural view of a connecting frame of a printing device with a detachable stapling device from another view angle according to a preferred embodiment of the present invention. Referring to FIG. 4, FIG. 5 and FIG. 6 together, the connecting frame 32 comprises a fixing hook 321, a locating post 322, a carrying portion 323, an extending portion 324 and a sleeve 326. The fixing hook 321 is disposed at a side of the connecting frame 3, able to swing relative to the connecting frame 32, and capable of inserting into the fixing slot 313 and fastening with the fixing slot 313. The locating post 322 is disposed at a side of the fixing hook 321 and capable of inserting into the locating hole 312. The locating post 322 comprises a first segment 3221 and a second segment 3222. The first segment 3221 has a first diameter D1, and the first diameter D1 is smaller than an internal diameter D1 of the locating hole 312 and thus the first segment 3221 is capable of inserting into the locating hole 312. The second segment 3222 has a second diameter D2, and the second diameter D2 is larger than the internal diameter Di of the locating hole 312 and thus the second segment 3222 is unable to insert into the locating hole 312. When the locating post 322 inserts into the locating hole 312, the second segment 3222 contacts with the surface 311 of the printing device housing 31, so as to separate the surface 311 of the printing device housing 31 from the stapling device housing 301.

In FIG. 5 and FIG. 6, the carrying portion 323 is located above the surface 311 of the printing device housing 31 and perpendicular to the surface 311, wherein the carrying portion 323 is capable of supporting the stapling device housing 301. The extending portion 324 is located at and formed by extending from a side of the connecting frame 32, and the extending portion 324 is perpendicular to a surface 325 of the connecting frame 32. Herein, the extending portion 324 comprises a protruding portion 3241 extended from the extending portion 324 and located under the sleeve 326, while the sleeve 326 is disposed on the extending portion 324 and perpendicular to the extending portion 324. In this preferred embodiment, the sleeve 326, the extending portion 324 and the connecting frame 32 are formed integrally.

In FIG. 5, the fixing hook 321 is disposed on the extending portion 324, and the fixing hook 321 comprises a sliding groove 3211, an opening 3212, a rotation shaft 3213, a poking portion 3214 and a torsion spring 2315 3215. The protruding portion 3241 of the extending portion 324 is capable of inserting into the sliding groove 3211, so as to restrict a swinging range of the fixing hook 321. In addition, the opening 3212 is located under the sliding groove 3211. In FIG. 6, the rotation shaft 3213 passes through the sleeve 326 of the connecting frame 32, and capable of rotating relative to the connecting frame 32 when the fixing hook 321 is swinging. The poking portion 3214 is formed by extending from the fixing hook 321, perpendicular to the extending portion 324 of the connecting frame 32 and capable of being poked to drive the fixing hook 321 swinging. The torsion spring 3215 is fitting onto the sleeve 326, wherein a first end 3215A of the torsion spring 3215 leans against another surface 327 of the connecting frame 32, and a second end 3215B of the torsion spring 3215 inserts into the opening 3212 and connects with the opening 3212. Therefore, the torsion spring 3215 is fixed and able to provide a torsion to the fixing hook 321, and thus the fixing hook 321 is pushed to fasten with the fixing slot 313 by the torsion when the fixing hook 321 is released.

Referring to FIG. 5 and FIG. 6 continuously, the hook control module 33 contacts with the poking portion 3214 of the fixing hook 321 and capable of being pressed, so as to drive the fixing hook 321 swinging relative to the connecting frame 32. The hook control module 33 comprises a pressing portion 331, a convex post 332 and a spring 333. The pressing portion 331 contacts with the poking portion 3214 and capable of being pressed by a finger of an user to lean against the poking portion 3214, so as to drive the fixing hook 321 swinging relative to the connecting frame 32. The convex post 332 is disposed on the pressing portion 331, while the spring 333 is fitting onto the convex post 332 and capable of generating an elastic force. The hook control module 33 is disposed on the side wall 302 of the stapling device housing 301, wherein the side wall 302 comprises a containing space 3021 and a convex post container 3022. The containing space 3021 is capable of containing the pressing portion 331. When the pressing portion 331 is pressed by an user, the pressing portion 331 is able to move in the containing space 3021. The convex post container 3022 is disposed at a side of the containing space 3021 and capable of containing the convex post 332 therein, wherein the convex post container 3022 has a convex post container rim 3022A. When the pressing portion 331 is pressed, the convex post container rim 3022A is capable of leaning against and compressing the spring 333. However, when the pressing portion 331 is released, the compressed spring 333 returns towards the original state and generates an elastic force, so as to move the pressing portion 331 in the containing space 3021 towards the uncompressed position.

According to the above mentioned descriptions, it can be understood that when the connecting frame 32 connects with the stapling device housing 301, the pressing portion 331 of the hook control module 33 is disposed in the containing space 3021 of the side wall 302. In addition, when the connecting frame 32 connects with the printing device housing 31, the locating post 322 of the connecting frame 32 inserts into the locating hole 312 to let the first segment 3221 of the locating post 322 contact with the inner wall (not shown) of the locating hole 312, so as to prevent the connecting post 322 tilting due to the weight of the stapling device 30. Furthermore, the second segment 3222 of the locating post 322 is unable to insert into the locating hole 312 due to the second diameter D2 of the second segment 3222 is larger than the inner diameter D1 of the locating hole 312. Hence, the surface 311 of the printing device housing 31 and the stapling device housing 301 are separated due to the second segment 3222 contacting with the surface 311 of the printing device housing 31, and thus the printing device housing 31 and the stapling device housing 301 are separated by the second segment 3222. Further, the fixing hook 321 inserts into the fixing slot 313 and swings relative to the connecting frame 32 to fasten with the fixing slot 313, so as to fixing the connecting frame 32 on the printing device housing 31.

Figure 7:
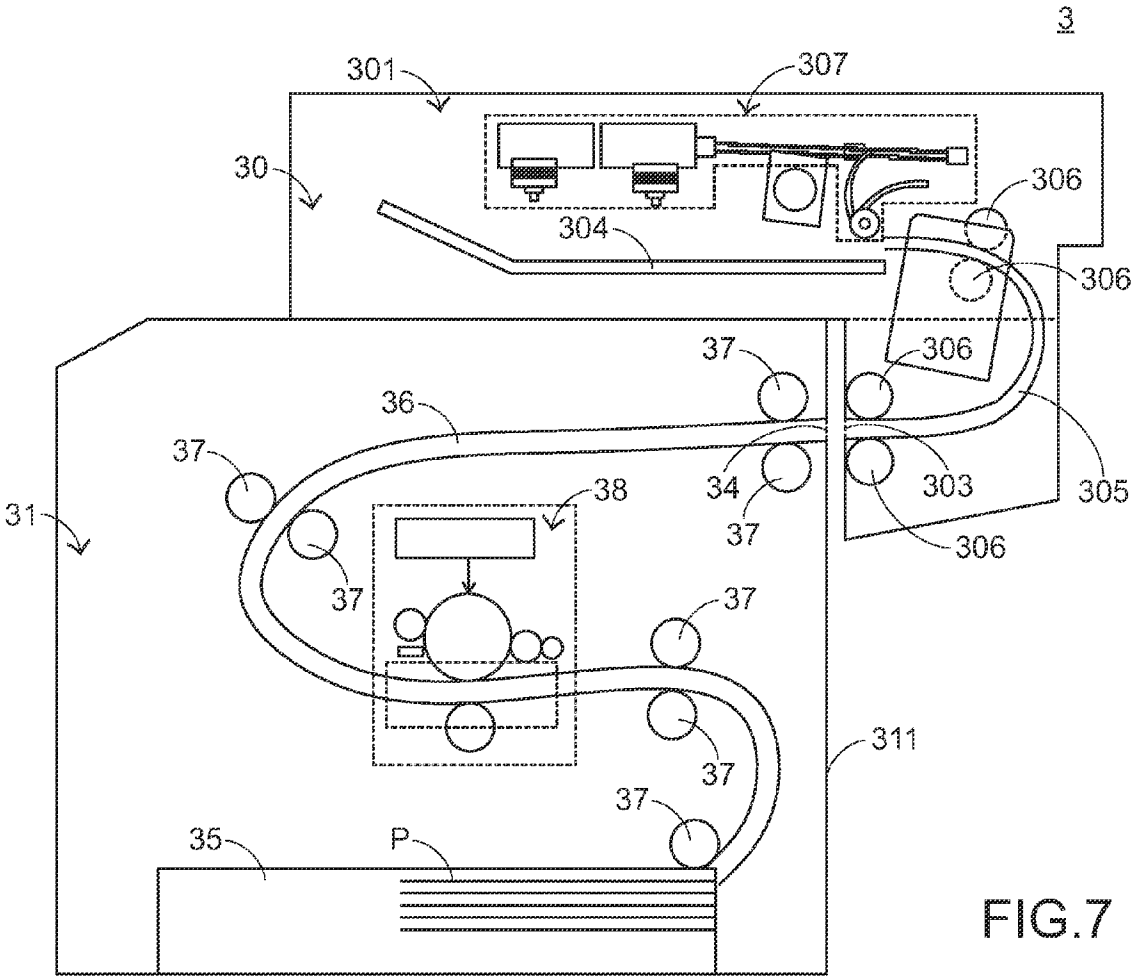
FIG. 7 illustrates a schematic inner structural view of a printing device with a detachable stapling device according to a preferred embodiment of the present invention.

Inner structures of the printing device 3 with the detachable stapling device are illustrated herein after. FIG. 7 illustrates a schematic inner structural view of a printing device with a detachable stapling device according to a preferred embodiment of the present invention. FIG. 7 illustrates the inner structure of the printing device 3 with the detachable stapling device without illustrating the structure of the connecting frame 32 therein. Referring to FIG. 7, besides the above mentioned elements, the printing device 3 with the detachable stapling device further comprises an input tray 35, a first feeding passage 36, a plurality of first feeding roller sets 37 and a printing module 38. The input tray 35 is located at a bottom of the printing device housing 31 and capable of carrying the plurality of papers P. The first feeding passage 36 is located between the input tray 35 and the paper outlet 34 and capable of feeding the plurality of papers P. The plurality of first feeding roller sets 37 are disposed on the first feeding passage 36 and capable of feeding the plurality of papers P to move in the first feeding passage 37. The printing module 38 is disposed on the first feeding passage 37 and capable of printing the plurality of papers P.

In FIG. 7, the stapling device 30 further comprises an output tray 304, a second feeding passage 305, a plurality of second feeding roller sets 306 and a stapling module 307. The output tray 304 is located in the stapling device housing 301 and capable of carrying the plurality of papers P. The second feeding passage 305 is located between the paper inlet 303 and the output tray 304 and capable of feeding the plurality of papers P. The plurality of second feeding roller sets 306 are disposed on the second feeding passage 305 and capable of feeding the plurality of papers P to move in the second feeding passage 305. The stapling module 307 is disposed above the output tray 304 and capable of stapling the plurality of papers P.

It should be note that the surface 311 of the printing device housing 31 is separated from the surface 325 of the stapling device housing 301 due to the structure of the second segment 3222 of the locating post 322 as shown in FIG. 7. The printing device housing 31 and the stapling device housing 301 are separated for ensuring the plurality of papers P able to be fed from the paper outlet 34 on the printing device housing 31 to the paper inlet 303 on the stapling device housing 301 smoothly. If the distance between the printing device housing 31 and the stapling device housing 301 is too close or too far, the plurality of papers P may not be fed into the paper inlet 303 on the stapling device housing 301 smoothly, even may not enter into the paper inlet 303. Herein, the distance between the printing device housing 31 and the stapling device housing 301 is obtained from repeated experiments. In a preferred embodiment, the distance therebetween is determined by the second segment 3222 of the locating post 322. When the second segment 3222 of the locating post 322 is designed shorter, the distance therebetween is reduced. Otherwise, when the second segment 3222 of the locating post 322 is designed longer, the distance therebetween is increased.

Figure 8:
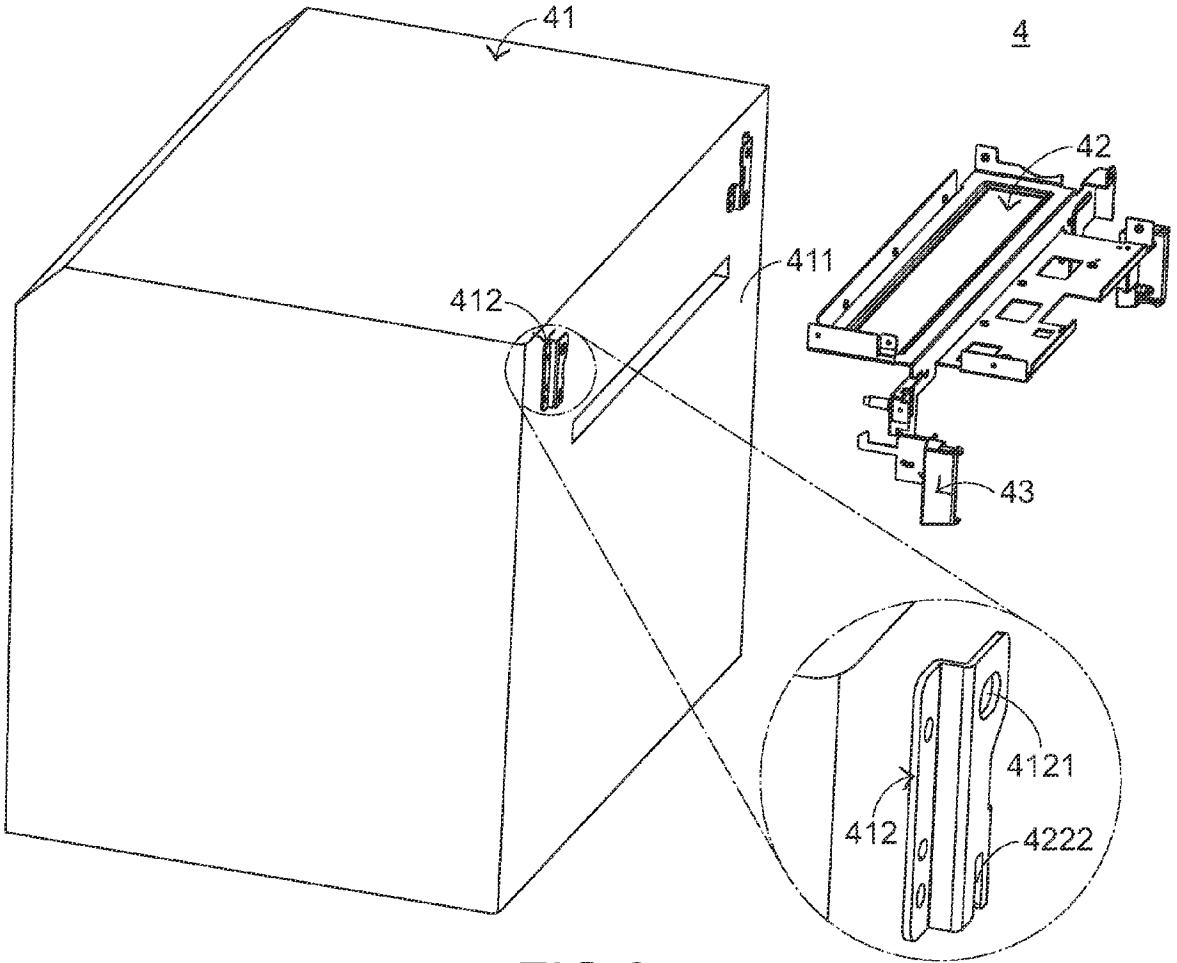
FIG. 8 illustrates a schematic outer contour view of a printing device housing of a printing device with a detachable stapling device according to another preferred embodiment of the present invention.

Furthermore, the present invention further provides another preferred embodiment. FIG. 8 illustrates a schematic outer contour view of a printing device housing of a printing device with a detachable stapling device according to another preferred embodiment of the present invention. Referring to FIG. 8, the printing device 4 with a detachable stapling device comprises a stapling device (not shown), a printing device housing 41, a connecting frame 42 and a hook control module 43. The structures of the printing device with the detachable stapling device in the present preferred embodiment and that in the above mentioned preferred embodiment are substantially the same except the structures of the printing device housings, so that the structures of the stapling device, the connecting frame and the hook control module are omitted herein. The printing device housing 41 has a surface 411, and the printing device housing 41 comprises a connecting piece 412 disposed on the surface 411 of the printing device housing 41. The connecting piece 412 comprises a locating hole 4121 and a fixing slot 4122, and the locating hole 4121 and the fixing slot 4122 are exposed on the surface 411 of the printing device housing 41.

In the present preferred embodiment, the printing device 4 with the detachable stapling device of the present invention further comprises a connecting piece 412, and the connecting piece 412 has the locating hole 4121 and the fixing slot 4122. The purpose of the connecting piece 412 is that users no need to drill holes on the printing device housing if there is neither locating hole nor fixing slot disposed on the printing device housing for connecting with the connecting frame. In another word, if there is a connecting piece 412 disposed on the surface of the printing device housing, it is able to connect the printing device with the connecting frame.

According to the above mentioned preferred embodiments, it can be understood that the printing device with the detachable stapling device of the present invention uses the connecting frame to connect the stapling device with the printing device housing, and the connecting frame provides a structure able to be detached and assembled easily. Therefore, users may assemble or detach the stapling device without using any additional tools. Further, since the two pressing portions of the hook control modules are disposed on two opposite side walls of the stapling device housing, users need to press the pressing portions with both hands at the same time, so as to release the engagement of the connecting frame and the printing device housing. In addition, users may further hold the side walls by using the containing spaces on the side walls with both hands, so as to detach the stapling device from the printing device housing stably.

Although specific embodiments of the present invention have been described, it will be understood by those of skill in the art that there are other embodiments that are equivalent to the described embodiments. Accordingly, it is to be understood that the invention is not to be limited by the specific illustrated embodiments, but only by the scope of the appended claims.

What is claimed is:

1. A printing device with a detachable stapling device capable of printing images on a plurality of papers, wherein the printing device with a detachable stapling device comprises:

a stapling device capable of stapling the plurality of papers, wherein the stapling device has a stapling device housing;

a printing device housing having a locating hole and a fixing slot, wherein the locating hole and the fixing slot are exposed on a surface of the printing device housing, and the fixing slot is located at a side of the locating hole;

a connecting frame connected with the stapling device housing and capable of fixing the stapling device on the printing device housing, wherein the connecting frame comprises:

a fixing hook disposed at a side of the connecting frame, able to swing relative to the connecting frame, and capable of inserting into the fixing slot and fastening with the fixing slot, so as to fixing the connecting frame on the printing device housing and thus connecting the stapling device housing and the printing device housing;

a carrying portion capable of supporting the stapling device housing;

an extending portion located at a side of the connecting frame and perpendicular to a surface of the connecting frame;

a sleeve disposed on the extending portion and perpendicular to the extending portion; and a locating post disposed at a side of the fixing hook and capable of inserting into the locating hole, so as to separate the surface of the printing device housing from the stapling device housing, wherein the locating post comprises:

a first segment having a first diameter, wherein the first diameter is smaller than an internal diameter of the locating hole, and the first segment is capable of inserting into the locating hole; and a second segment having a second diameter, wherein the second diameter is larger than the internal diameter of the locating hole, and the second segment is capable of contacting with the surface of the printing device housing, so as to separate the surface of the printing device housing from the stapling device housing.

2. The printing device with the detachable stapling device as claimed in claim 1, wherein the fixing hook is disposed on the extending portion, and the sleeve, the extending portion and the connecting frame are formed integrally.

3. The printing device with the detachable stapling device as claimed in claim 1, wherein the fixing hook comprises a sliding groove, and the extending portion comprises a protruding portion, the protruding portion is extended from the extending portion, located under the sleeve and capable of inserting into the sliding groove, so as to restrict the fixing hook swinging.

4. The printing device with the detachable stapling device as claimed in claim 1, wherein the fixing hook comprises:

an opening;

a rotation shaft passing through the sleeve of the connecting frame, and capable of rotating relative to the connecting frame when the fixing hook is swinging;

a poking portion perpendicular to the extending portion of the connecting frame and capable of being poked to drive the fixing hook swinging; and a torsion spring fitting onto the sleeve, wherein a first end of the torsion spring leans against another surface of the connecting frame, and a second end of the torsion spring inserts into the opening and connects with the opening, so as to provide a torsion to the fixing hook.

5. The printing device with the detachable stapling device as claimed in claim 4, further comprising a hook control module contacting with the poking portion of the fixing hook and capable of being pressed, so as to drive the fixing hook swinging relative to the connecting frame, wherein the hook control module comprises:

a pressing portion contacting with the poking portion and capable of being pressed to lean against the poking portion, so as to drive the fixing hook swinging relative to the connecting frame;

a convex post disposed on the pressing portion; and a spring fitting onto the convex post and capable of generating an elastic force.

6. The printing device with the detachable stapling device as claimed in claim 5, wherein the stapling device housing comprises a side wall, and the side wall comprises:

a containing space capable of containing the pressing portion; and a convex post container disposed at a side of the containing space and capable of containing the convex post therein, wherein the convex post container has a convex post container rim capable of leaning against the spring when the pressing portion is pressed.

7. The printing device with the detachable stapling device as claimed in claim 1, further comprising a paper outlet located on the surface of the printing device housing to let the plurality of papers pass through and then leave away the printing device housing, and the stapling device further comprising a paper inlet disposed on the stapling device housing and located under the connecting frame to let the plurality of papers pass through and then enter into the stapling device, wherein the paper outlet is separated from the paper inlet by the second segment of the locating post.

8. The printing device with the detachable stapling device as claimed in claim 7, further comprising:

an input tray located at a bottom of the printing device housing and capable of carrying the plurality of papers;

a first feeding passage located between the input tray and the paper outlet, and capable of feeding the plurality of papers;

a plurality of first feeding roller sets disposed on the first feeding passage and capable of feeding the plurality of papers to move in the first feeding passage; and a printing module disposed on the first feeding passage and capable of printing the plurality of papers; and the stapling device further comprising:

an output tray located in the stapling device housing and capable of carrying the plurality of papers;

a second feeding passage located between the paper inlet and the output tray and capable of feeding the plurality of papers;

a plurality of second feeding roller sets disposed on the second feeding passage and capable of feeding the plurality of papers to move in the second feeding passage; and a stapling module disposed above the output tray and capable of stapling the plurality of papers.

9. The printing device with the detachable stapling device as claimed in claim 1, wherein the printing device housing comprises a connecting piece disposed on the surface of the printing device housing, and the locating hole and the fixing slot are disposed on the connecting piece, so as to expose the locating hole and the fixing slot on the surface.

* * * * *